US005095969A

United States Patent [19]

Soejima et al.

[11] Patent Number: 5,095,969

[45] Date of Patent: Mar. 17, 1992

[54] ELECTROMAGNETIC AGITATING METHOD IN MOLD OF CONTINUOUS CASTING OF SLAB

[75] Inventors: Toshiyuki Soejima; Tadashi Saito, both of Kobe; Nobuyuki Genma, Kakogawa; Masayasu Kimura, Kakogawa; Yasuo Kaihara, Kakogawa, all of Japan

[73] Assignee: Kabushiki Kaisha Kobe Seiko Sho, Kobe, Japan

[21] Appl. No.: 544,668

[22] Filed: Jun. 27, 1990

[30] Foreign Application Priority Data

Jun. 27, 1989 [JP] Japan ..... 1-164875

[51] Int. Cl.[5] ..... B22D 27/02

[52] U.S. Cl. ..... 164/468; 164/504

[58] Field of Search ..... 164/468, 504

[56] References Cited

U.S. PATENT DOCUMENTS 4,649,985 3/1987 Mizota et al. ..... 164/504

FOREIGN PATENT DOCUMENTS 60-37251 2/1985 Japan .
61-255749 11/1986 Japan .
63-119959 5/1988 Japan .
63-154246 6/1988 Japan .

*Primary Examiner*—Kuang Y. Lin
*Attorney, Agent, or Firm*—Oblon, Spivak, McClelland, Maier & Neustadt

[57] ABSTRACT

An electromagnetic agitating method in a casting mold for the continuous casting of a slab in which electromagnetic agitating devices for generating a thrust force in the slab drawing direction are arranged at at least an inner wide surface of both inner and outer surfaces of the slab casting mold in a bending type continuous casting machine. The thrust force in the drawing direction applied to molten steel within the casting mold by the electromagnetic agitating devices is substantially applied from the narrow surface of the casting mold toward the center thereof in a range except a predetermined length in order to perform an electromagnetic agitation of molten steel.

8 Claims, 9 Drawing Sheets

ELECTROMAGNETIC AGITATING METHOD IN MOLD OF CONTINUOUS CASTING OF SLAB

BACKGROUND OF THE INVENTION

1. Field of the Invention

This invention relates to an electromagnetic agitating method in a mold for continuously casting a steel slab.

2. Description of the Prior Art

A continuous casting of a slab is carried out by a method wherein molten steel poured into a mold from a tundish through an immersed nozzle is cooled from its surrounding part by a wall of the mold and then a solidified shell is pulled while forming and growing in the mold. In this case, as shown in FIG. 10, the molten steel fed from the tundish (not shown) into the mold flows out through a discharging hole 16 of the immersed nozzle 15, the molten steel stream 17 may strike against a narrow surface part 18 of the mold M to generate a descending flow 19 and then this descending flow 19 may deeply immerse into a slab S as a major flow of the molten steel flow.

According to this type of continuous casting method, it is already known that some obstacles or bubbles such as argon gas enclosed in the descending flow 19 are caught at the interface of the consolidated shell to form an accumulated obstacle band which will be exposed as defects during a rolling operation.

In recent years, in order to improve such a problem as above, there is provided a continuous casting method in which an electromagnetic agitating operation is applied.

For example, Jap. Pat. Laid-Open No. Sho 60-37251 describes a method for improving the quality of a casted piece by a method wherein two electromagnetic agitating devices are separately arranged within a wide surface of the mold at right and left sides, and agitating force directions of the separated electromagnetic agitating devices are changed over for their operation.

SUMMARY OF THE INVENTION

In the electromagnetic agitating method in a mold described in the aforesaid Jap. Pat. Laid-Open No. Sho 60-37251, the electromagnetic agitating devices are separately arranged at right and left sides within a wide surface of the mold, providing the advantage of increasing the number of agitating patterns of the molten steel. Additionally, the agitating flows may be selected in response to the type of steel and a casting condition. However, it is not apparent that these agitating flows may improve the quality of the casted pieces and further the descending flow 19 immersed deeply into the aforesaid slab S is not restricted, so that the aforesaid method has a problem in that obstacles or bubbles such as argon gas enclosed in the descending flow 19 are not reduced.

In view of the foregoing, the present applicant has studied earnestly in order to resolve this problem and found that the accumulated band of the obstacles could be improved by arranging the electromagnetic agitating device for generating a thrusting force in a slab pulling direction within a wide surface of the mold and then by applying a thrust force of electromagnetic agitation in the same direction as the pulling direction of the slab. The applicant has filed a previous application (Jap. Pat. Appln. No. Sho 63-243639). However, after that application, the applicant found that the accumulated band of obstacles was not improved sometimes even by applying the electromagnetic agitating method of this prior application and in particular, during use of a variable mold, it was not improved for the sake of a certain slab size.

In view of the foregoing, the applicant continued to study earnestly and found that the descending flow 19 immersing into the aforesaid slab S could be restricted if a distribution of the agitating thrust in a slab wide surface width direction does not correspond to the slab width by the electromagnetic agitating device even if the electromagnetic agitating device generating a thrust force in the pulling direction is arranged within the wide surface of the mold, and so the obstacles or bubbles such as argon gas and the like enclosed in the descending flow 19 may not be reduced.

The present invention has been completed in view of the foregoing circumstances, wherein a distribution of the agitating thrust force in a direction of slab wide surface width of the electromagnetic agitating device is varied in response to the slab width so as to restrict a descending flow deeply immersing into the slab. According to the invention, an electromagnetic agitating device generating a thrust force in a pulling direction of the slab is arranged in at least an inner surface of both outer and inner wide surfaces of the mold for slab in a bending mold continuous casting machine and at the same time a thrust force in the pulling direction to be applied to the molten steel within the mold given by the electromagnetic agitating device is substantially applied to a range except a predetermined length toward a central part from a narrow surface of the mold so as to perform an electromagnetic agitation of the molten steel.

BRIEF DESCRIPTION OF THE DRAWINGS

FIGS. 5(*b*) to FIG. 6(*b*) are illustrative views for showing a molten steel flow in case that the electromagnetic agitating device is not arranged in the wide surface of the prior art mold.

DESCRIPTION OF THE PREFERRED EMBODIMENTS

The present invention will be described in detail as follows.

Figure 1:
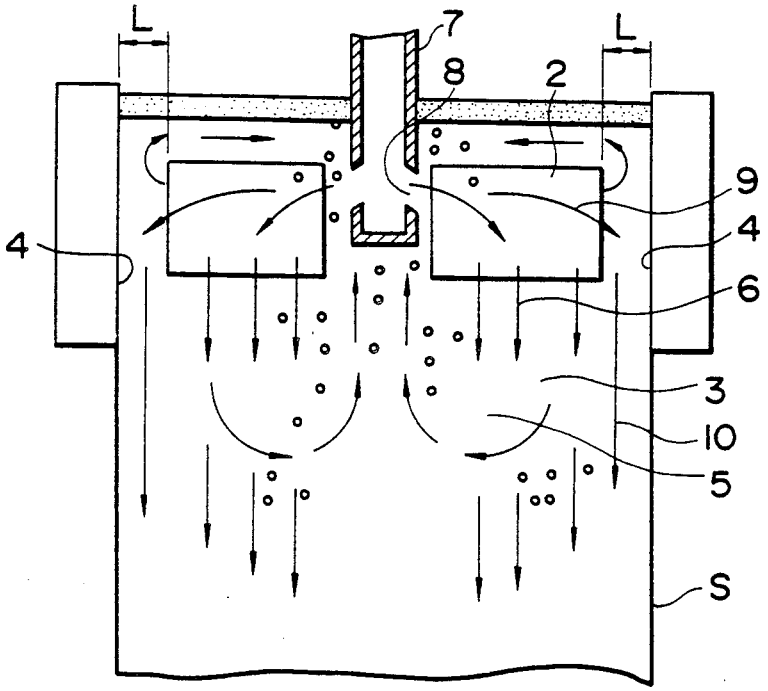
FIG. 1 is an illustrative view for showing an apparatus to be used in an electromagnetic agitating method in a mold in a continuous casting of slab of the present invention.
Figure 2:
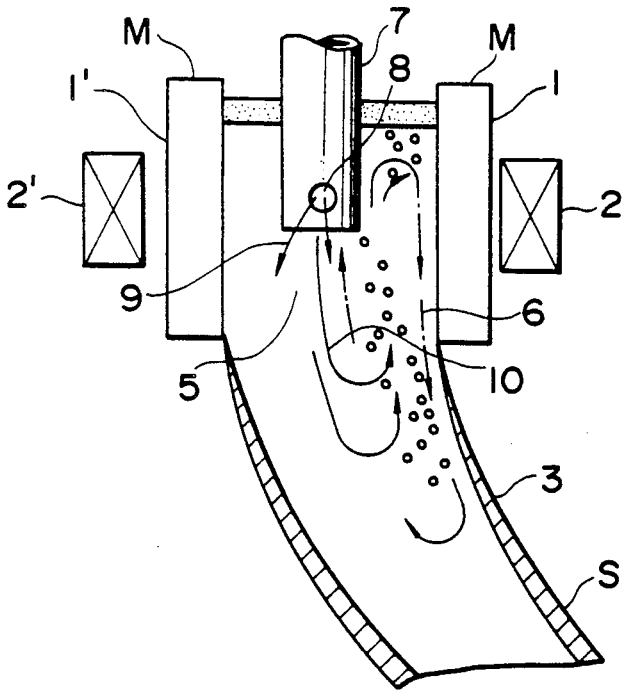
FIG. 2 is a sectional view of FIG. 1.
Figure 3:
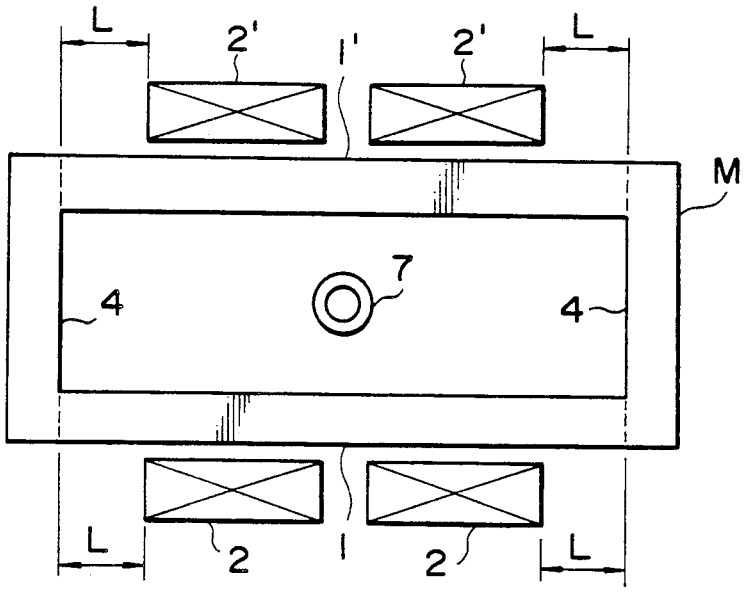
FIG. 3 is a top plan view of FIG. 1.

The present invention is operated such that as shown in FIGS. 1 to 3, the electromagnetic agitating device 2 for use in generating a thrust force in a pulling direction of the slab S arranged at an inner wide surface 1 of a bending arc of the slab mold M in the bending type continuous casting machine is applied or both the electromagnetic agitating device 2 and an electromagnetic agitating device 2' for use in generating a thrust force in the pulling direction of the slab S are applied, and the thrust force in the thrusting direction applied to the molten steel 5 by these electromagnetic agitating devices 2 and 2' is substantially applied to a range except a predetermined length L from the right and left side ends (narrow surfaces) 4 of the slab wide surface 3 to be casted toward the central part.

Under such a condition as above, if the thrusting force in the pulling direction of the electromagnetic device is acted upon the molten steel 5 within the slab mold M, the molten steel flow 6 is induced in the molten steel 5. As shown in a comparison at FIGS. 5(*a*) and (*b*) between a case in which the electromagnetic agitating device 2 is arranged in the inner wide surface 1 of the slab mold M (the present invention) and the case in which it is not so arranged (a prior art), a discharging flow speed of the molten steel flow 9 discharged from the discharging hole 8 of the immersed nozzle 7 toward the narrow surface is reduced, an immersion depth of the molten steel flow 10 immersed into the slab S along the narrow surface of the slab mold M is restricted and at the same time the obstacles or bubbles such as argon gas enclosed in the molten steel flow 10 are prevented from being deeply immersed into the slab S and further a total amount of obstacles brought into the slab S can be reduced to such a level as to ensure no problem in quality.

Figure 6A:
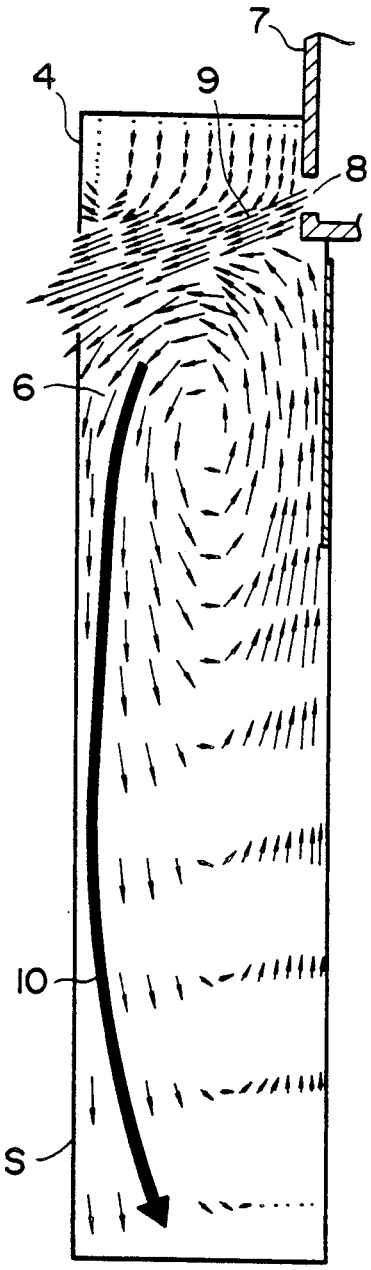
FIG. 6(a) PRIOR ART
FIG. 6(*a*) is an illustrative view for showing a molten steel flow in a mold relating to an example of comparison.
Figure 6B:
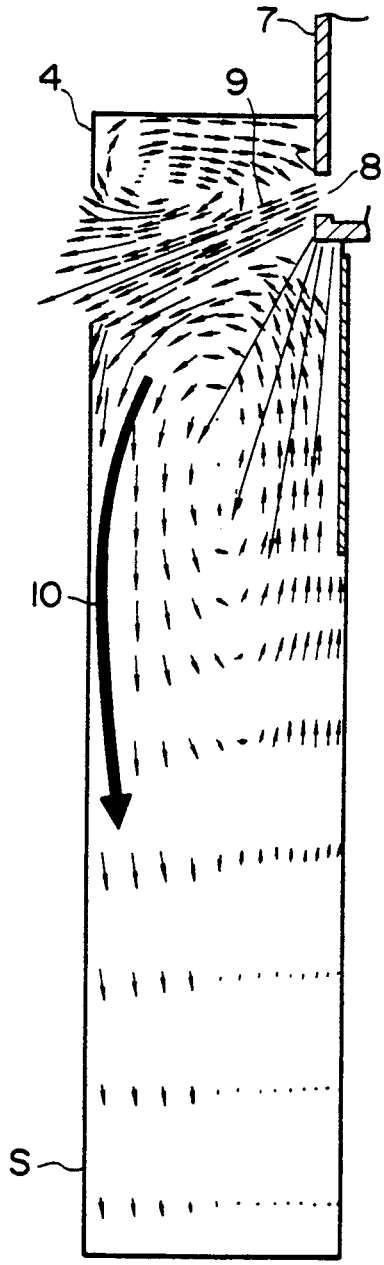
FIG. 6(b) PRIOR ART

However, even in case of applying a thrust force to the electromagnetic agitating device 2 in the same direction as the pulling direction of the slab S, an application of the thrust force up to the narrow surface 4 of the slab S causes an immersion depth of the molten steel flow 10 immersing into the slab S along the narrow surface 4 of the slab mold M to be further increased if the electromagnetic agitating device 2 is arranged in the slab mold M (FIG. 6(*a*)) as compared with the case in which the electromagnetic agitating device 2 is not arranged in the slab mold M, resulting in that the obstacles or bubbles such as argon gas enclosed in the molten steel flow 10 immerse deeply into the slab.

According to our experiment and the like, a predetermined length L where the thrust force in the pulling direction of the aforesaid electromagnetic agitating device 2 may not apply is 50 mm or more and preferably 100 mm or more. If this length is less than 100 mm, an immersion depth of the molten steel flow 10 is not sufficiently restricted and an effect of reducing obstacles in the slab or bubbles such as argon gas is eliminated.

Figure 5A:
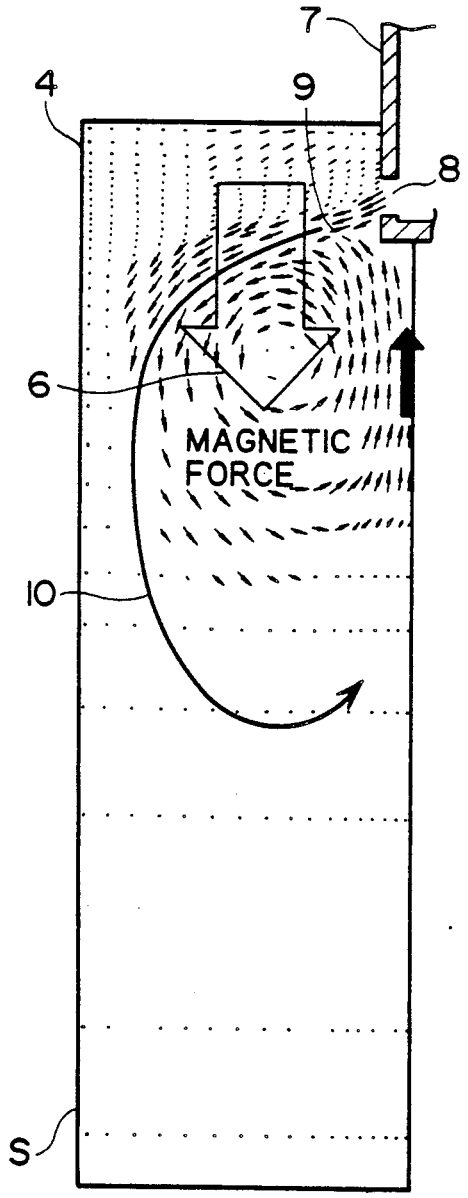
FIG. 5(*a*) is an illustrative view for showing a molten steel flow in a mold of the present invention.
Figure 5B:
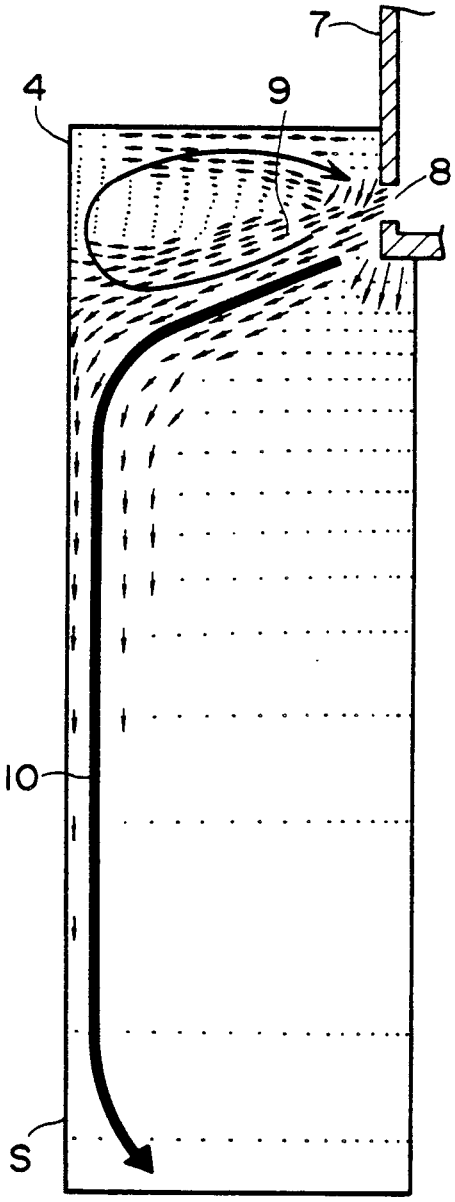
FIG. 5(b) PRIOR ART

FIGS. 5 and 6 are symmetrical views as viewed from the wide surface, so that only their half sides will be illustrated.

The degree of the thrust force applied in the pulling direction given by the electromagnetic agitating device will be described in detail in reference to the preferred embodiments described later. It is preferable to select a range of 2500 to 11,000 $N/m^3$ in order to get an effect of reducing the obstacles.

EXAMPLE 1

A total number of four units of linear motor type electromagnetic agitating devices 2 and 2' are arranged at both sides of the inner wide surface 1 and the outer wide surface 1' of the mold M at their symmetrial positions in width direction as shown in FIG. 3 by applying a bending type continuous casting machine having a slab mold M of which width size can be varied in a thickness of 230 mm × a width of 800 to 1630 mm. These electromagnetic agitating devices 2 and 2', the narrow surface 4 of the casting mold M and the distance L were varied within a range of −50 to 250 mm by varying a width of the casting mold, the thrust force in the pulling direction by these electromagnetic agitating devices was kept constant ($F=10{,}500\ N/m^3$) and a soft killed steel having molten steel components of C:0.04 to 0.05%, Mn: 0.25 to 0.35%, Al: 0.003 to 0.020% was casted into slabs having widths of 900 mm, 1000 mm, 1100 mm, 1200 mm, 1400 mm and 1500 mm under a drawing speed of 1.4 m/min.

Figure 7:
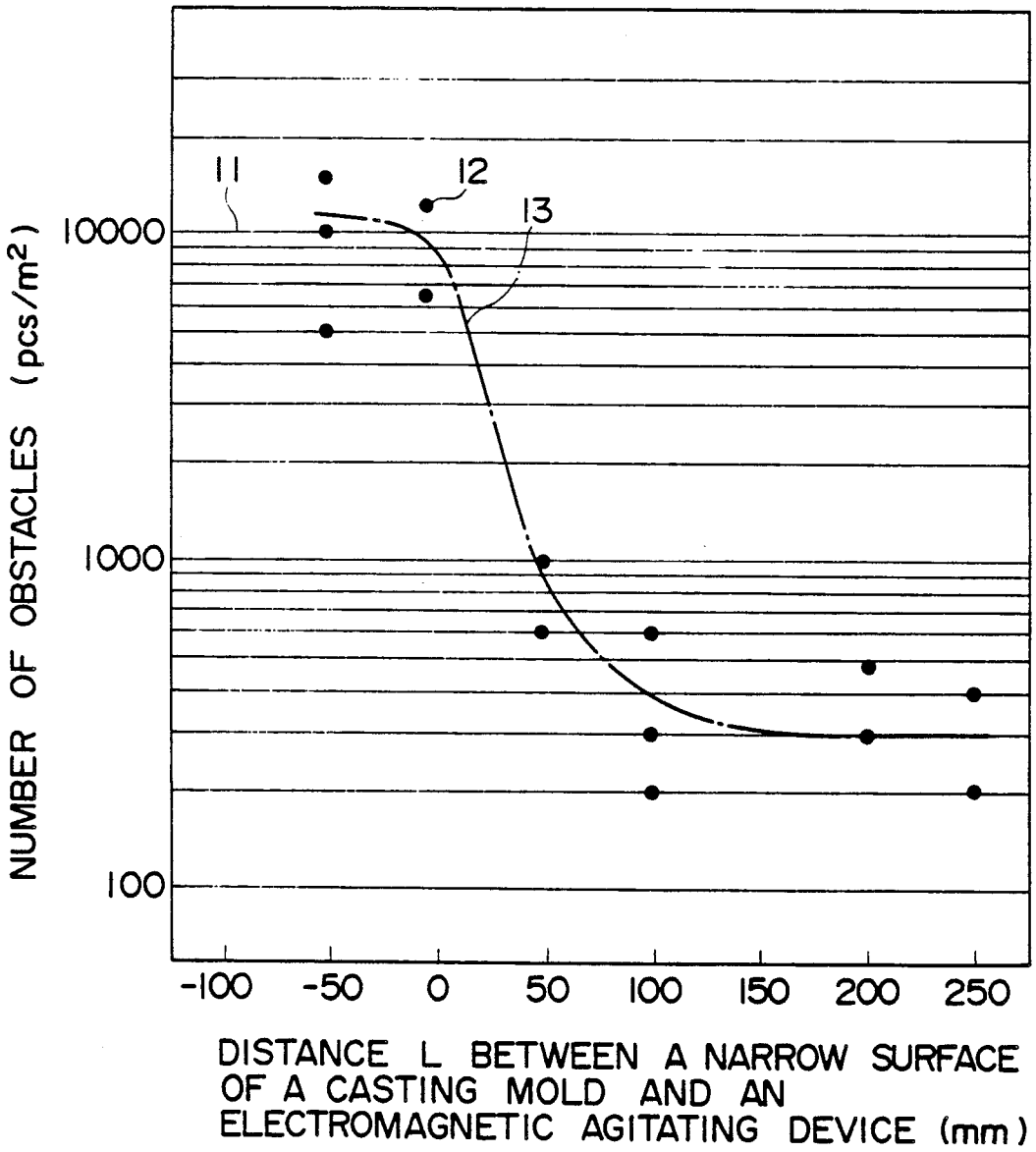
FIG. 7 is a graph for showing a relation between a distance where a thrust force of the electromagnetic agitating device may act and the number of obstacles.

FIG. 7 shows a result in which obstacles of more than a size of 100 μm present between a position of 22 mm and a position of 52 mm from an inside surface of the slabs manufactured in this way were surveyed over an entire width of the slab. In regards to a lateral axis L in FIG. 7, L=0 means a case in which as apparent from FIG. 3, a position of the narrow surface 4 of the mold M and a position of an outer end surface facing to the narrow surfaces of the electromagnetic agitating devices 2 and 2' coincide with each other, and L=a minus value means that the outer end surfaces of the electromagnetic agitating devices 2 and 2' exceed the position of the narrow surface 4 and are shifted outwardly.

Figure 11:
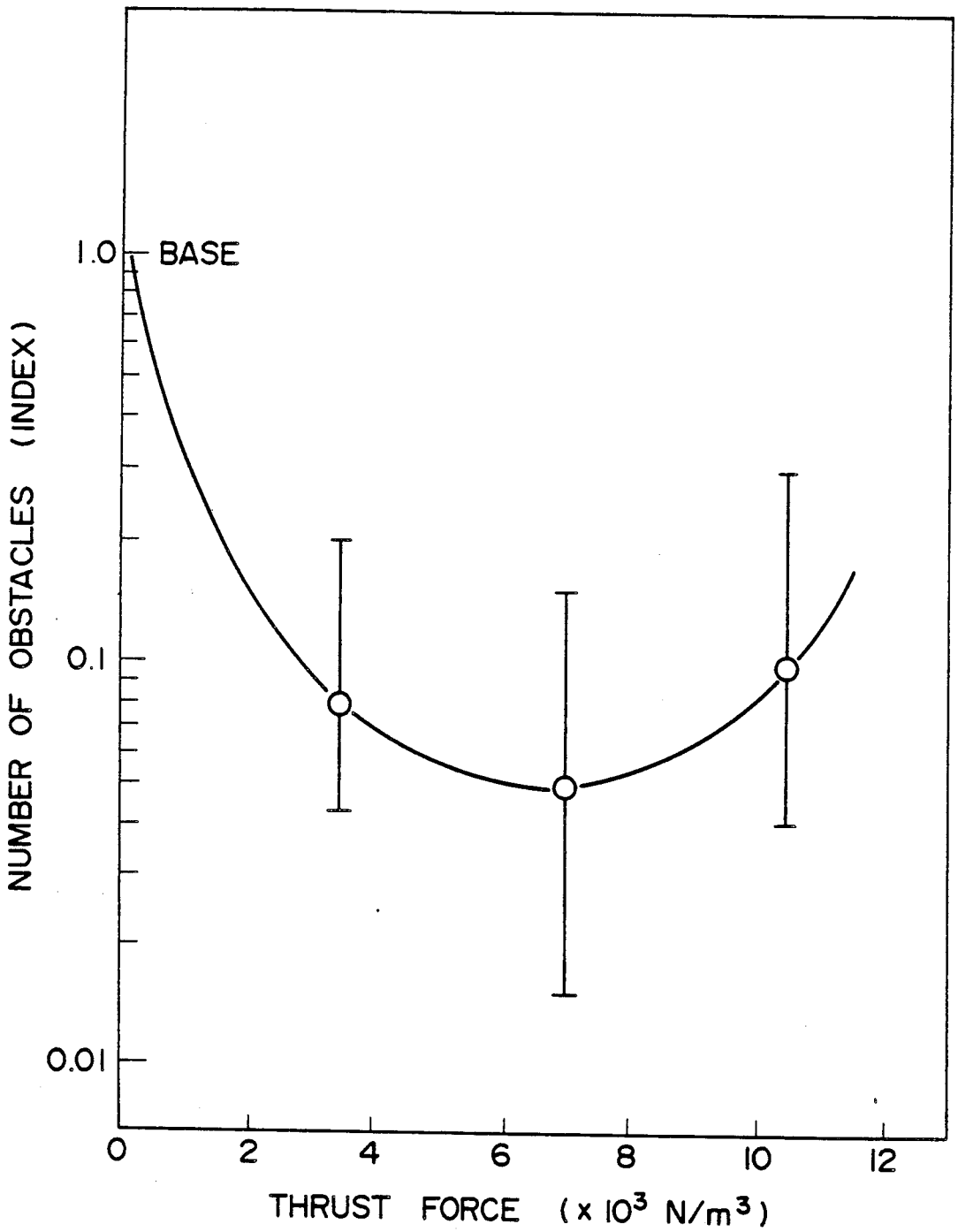
FIG. 11 is a graph for showing a relation between a magnitude of thrust force of the electromagnetic agitating device and the number of obstacles.

In FIGS. 7, 11 denotes a rigid line showing a level of the number of typical obstacles in case of not applying the thrust force of the electromagnetic agitating device. 12 denotes a point for indicating the actual measured number of obstacles for every value L in the case that a thrust force is applied by the agitating device. 13 denotes an alternate long and short line for showing the mean number of obstacles of the actual measured number of obstacles and as apparent from this figure, an effect of reducing the number of obstacles was not acknowledged at L= −50 and L=0 where the thrust force of the electromagnetic agitating device may act up to the narrow surface and a remarkable effect of reducing the number of obstacles was acknowledged when L=50 mm or more was attained.

EXAMPLE 2

Figure 4:
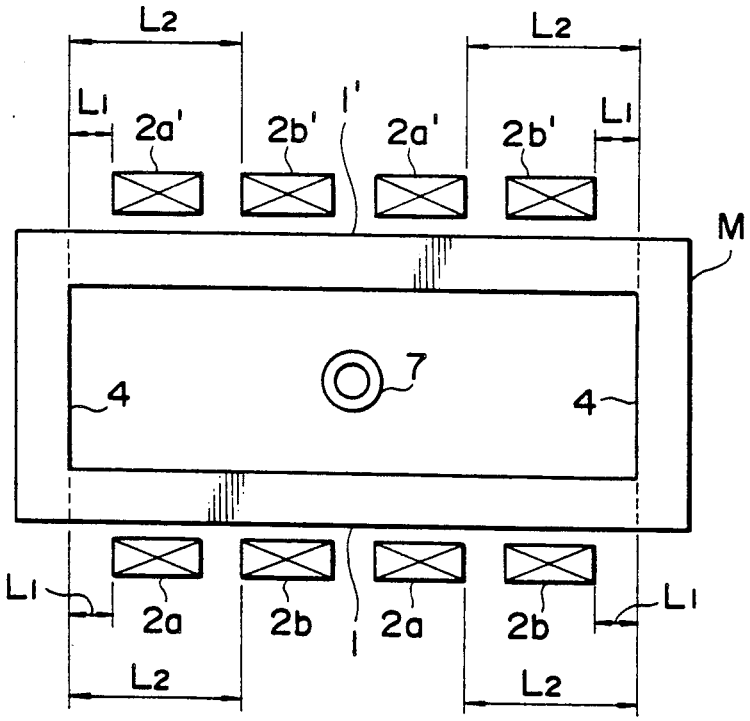
FIG. 4 is an illustrative view for showing an apparatus of another preferred embodiment to be applied in an electromagnetic agitating method in a mold in a continuous casting of a slab of the present invention.
Figure 8:
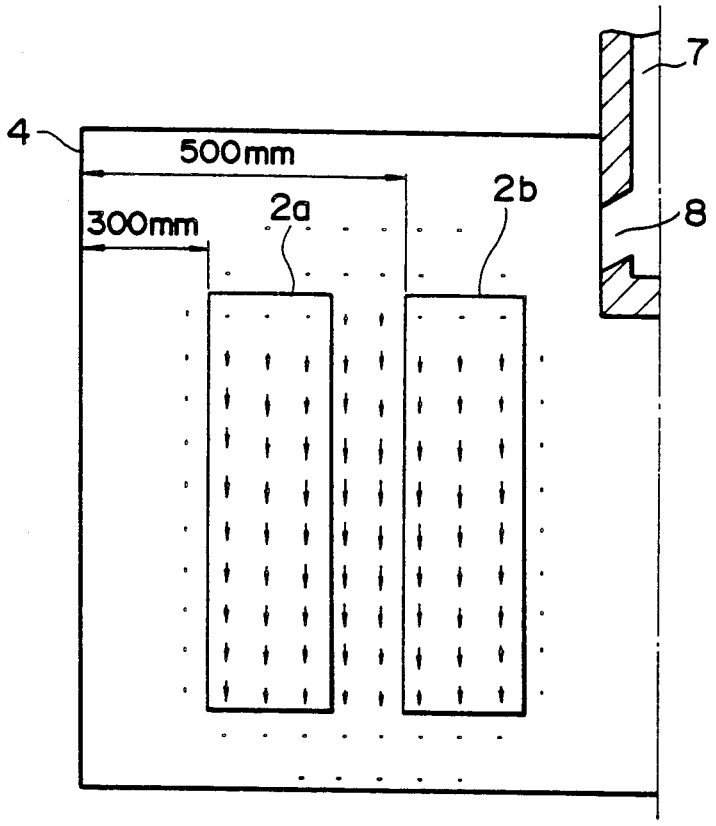
FIG. 8 is an illustrative view for showing an apparatus of another preferred embodiment to be applied in the electromagnetic agitating method in a continous casting of the slab of the present invention.

As shown in FIGS. 4 and 8, a total number of eight linear motor type electromagnetic agitating devices 2*a*, 2*b*, 2*a'* and 2*b'* were installed at both sides of the inner wide surface 1 and the outer wide surface 1' of the casting mold M and at the right and left symmetrical positions in width direction by applying a bending type continuous casting machine having the slab casting mold with variable width of the same size as that of Example 1. The electromagnetic agitating devices 2*a* and 2*a'* positioned at the casting mold narrow surface 4 sides in the width direction were positioned at about 300 mm from the narrow surface under the maximum width (1630 mm) of the casting mold, and the electromagnetic agitating devices 2*b* and 2*b'* positioned at the center of the casting mold were arranged at a position spaced apart by about 500 mm from the narrow surface thereof.

When the slab widths were 1630 to 1100 mm, all the electromagnetic agitating devices 2a, 2b, 2a' and 2b' were used while varying a width of the casting mold by using the continuous casting machine having these electromagnetic agitating devices and in turn when the slab width was 1100 to 800 mm, only the electromagnetic agitating devices 2b and 2b' were used, a soft killed steel having the same composition as that of the example 1 was casted into slabs under a drawing speed of 1.4 m/min by keeping a thrust force in the pulling direction by these electromagnetic agitating devices constant ($F=10{,}500 N/m^3$).

Figure 9:
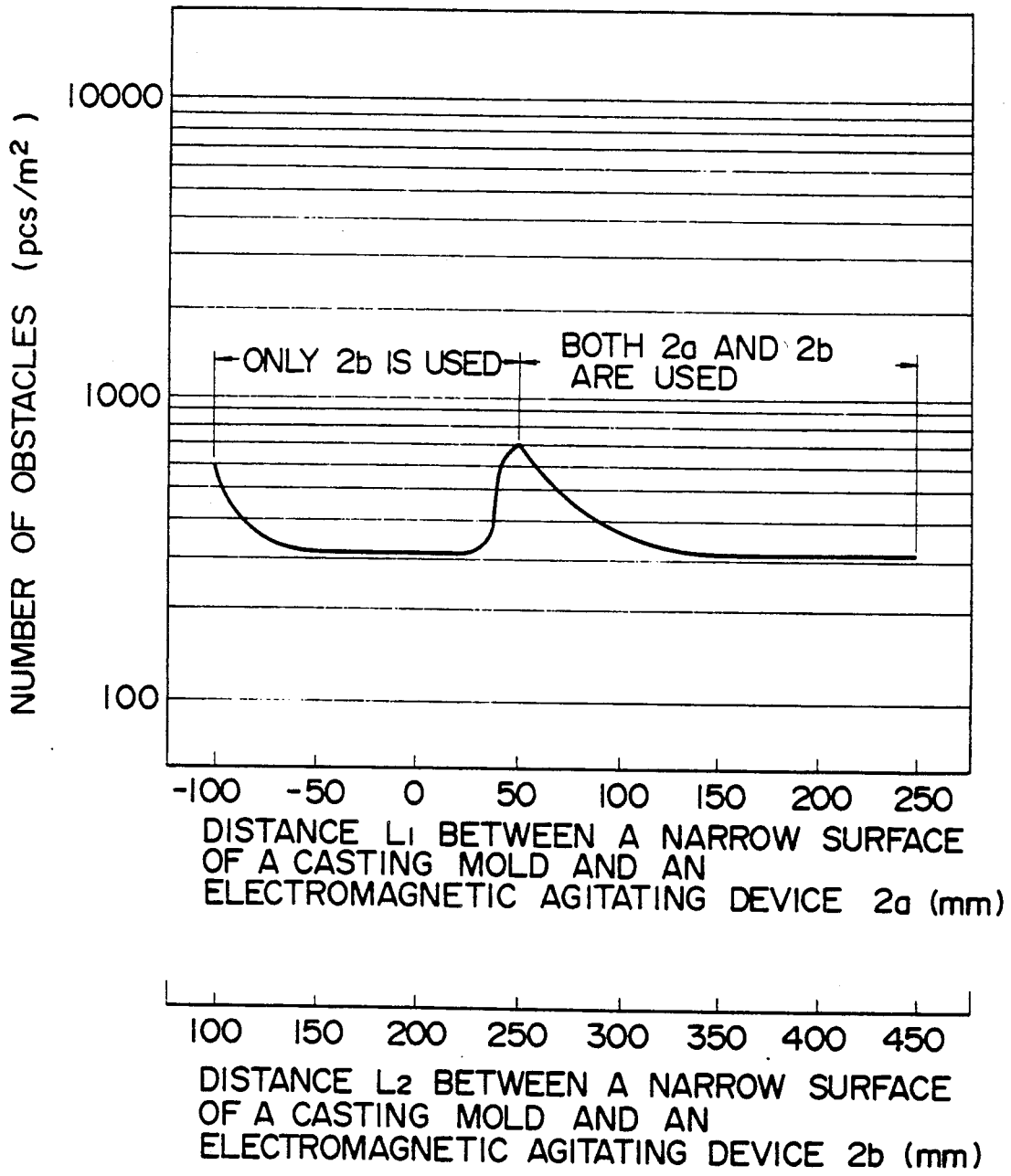
FIG. 9 is a graph for showing a relation between a distance where a thrust force of the electromagnetic agitating device may act and the number of obstacles.
Figure 10:
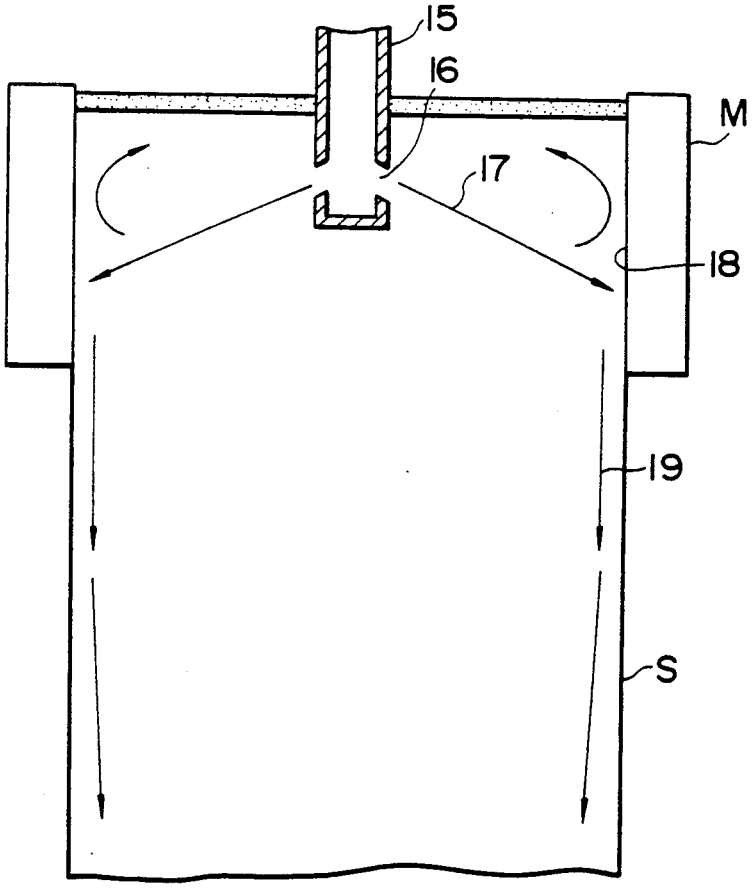
FIG. 10 PRIOR ART
FIG. 10 is an illustrative view for showing the prior art.

FIG. 9 shows a result in which the slabs got in this way were surveyed in the same manner as that of the example 1. It shows a relation among a distance $L_1$ between the narrow surface of the casting mold and the electromagnetic agitating device 2a (=2a'), a distance $L_2$ between the narrow surface of the casting mold and the electromagnetic agitating device 2b (=2b') and the number of obstacles having sizes more than 100 μm.

In FIG. 9, a right half region shows a case in which the electromagnetic agitating devices 2a, 2b, (2a', 2b') are used together and indicates a condition of occurrence of obstacles within a range of $L_1=50$ to 250 mm, and in turn a left half region indicates another case in which only the electromagnetic agitating device 2b (2b') is used, it indicates a condition of occurrence of the obstacles in a range of $L_2=100$ to 250 mm and they show that a quite less volume of obstacles is found. That is, this preferred embodiment means that even in case that a width of the casting mold is widely varied, if the electromagnetic agitating devices are divided into a plurality of segments at the narrow surface side and the central side of mold, these electromagnetic agitating devices are separately used in response to the width of the casting mold during casting operation to enable the thrust force applied in the drawing direction to be always acted upon except the predetermined range of the narrow surface side of the casting mold (in this case $L \geqq 50$ mm).

As apparent from FIG. 9, if the casting mold is of a variable casting mold M, the electromagnetic agitating device 2 is divided into a plurality of segments 2a and 2b, and an immersing depth of the molten steel flow 10 immersing into the slab S can be positively restricted in correspondence with a wide width of the slab S to be casted by the casting mold M, thereby the number of obstacles in the slab can be positively reduced.

FIG. 8 is a right and left symmetrical view as viewed from a wide surface, so that only the left half of it is shown and illustrated.

The present invention is not limited to the above-mentioned preferred embodiments, but a shielding plate is arranged between the electromagnetic agitating device 2 and the wall surface of the casting mold in such a way as it may be moved in rightward or leftward direction so as to control a thrust force of the electromagnetic agitating device 2 acting against the slab S.

EXAMPLE 3

As shown in FIG. 3, a total number of four linear motor type electromagnetic agitating devices 2 and 2' were arranged at the right and left symmetrical positions along the length of the inner and outer long sides 1 and 1' of the casting mold M by using a bending type continuous casting machine having a slab casting mold of a thickness of 230 mm × a width of 1230 mm. Each of the electromagnetic agitating devices was arranged such that a distance L between the agitating device and the narrow surface of the casting mold was 130 mm and a thrust force in the drawing direction applied by these electromagnetic agitating devices (F) was varied to show various values, a low carbon aluminum killed steel (C: 0.04 to 0.05%, Mn: 0.15 to 0.25%, Al: 0.030 to 0.050%) was casted into a slab having a width of 1230 mm under a drawing speed of 1.0 to 1.45 m/min.

Obstacles having a size more than 100 μm present in a range of 22 mm to 52 mm from a inside surface of the slab custed in this way were surveyed for an entire width region of the slab.

The aforesaid value (F) can be attained by the following equation.

$$F = \frac{\tau . f}{\rho} B^2 \ (N/m^3)$$

where, $\tau$: pole pitch (mm)

$\rho$: specific resistance of molten steel (μΩcm)

f: frequency (Herz)

B: magnetic flux density (Gauss)

The above B is a value measured at a position spaced apart by 20 mm from the wall surface of the casting mold.

FIG. 11 is a graph for showing a relation between a thrust force (F) and the number of obstacles in reference to a result of surveying the obstacles. In this case, as the number of obstacles, an index number expressed by a ratio in respect to the number when the agitation was not carried out was used. In this FIGURE, as the thrust force is increased, the effect of reducing the obstacles appears rapidly. As this is further increased, the reduction of the obstacles is acknowledged as compared with the case in which the agitation is not carried out, and its effect is reduced. Accordingly, the thrust force (F) should be set within a range of 2500 to 11,000 $N/m^3$ and preferably 4500 to 9000 $N/m^3$, and further most preferably, 5500 to 8000 $N/m^3$ for the operation.

As described above, according to the present invention, the thrust force in the drawing direction of the electromagnetic agitating devices arranged at the inner wide surface or both inner and outer wide surfaces of the slab casting mold is acted toward the central part of the mold from the narrow surface of the casting mold in a range except the predetermined length, so that an immersing depth of the molten steel flow immersing into the slab along the narrow surface of the casting mold is restricted, the obstacles or bubbles such as argon gas are prevented from deeply immersing into the slab, resulting in that a high quality slab can be attained.

What is claimed is:

1. A method for enhancing the removal of bubbles and other obstacles during the continuous casting of a steel slab in a bending type continuous casting machine, said method comprising the steps of:

pouring molten steel into a mold having a short side, an inner long side, and an outer long side;

generating a thrust force in a slab drawing direction of the molten steel using a plurality of electromagnetic agitating devices arranged along said inner long side;

electromagnetically agitating the molten steel with the electromagnetic agitating devices by applying the thrust force to the molten steel only within a central range of the mold, said central range being spaced by a predetermined distance from the short side of the mold, said predetermined distance is 50 mm or more so as to enhance the removal of bubbles and other obstacles from the molten steel.

2. The method according to claim 1, wherein said predetermined distance is 100 mm or more.

3. The method according to claim 1, further comprising the step of:

arranging a plurality of additional electromagnetic agitating devices along said outer long side of said mold.

4. The method according to claim 3, wherein at least two electromagnetic agitating devices are arranged along each of said inner and outer long sides.

5. The method according to claim 3, wherein at least four electromagnetic agitating devices are arranged along each of said inner and outer long sides.

6. An electromagnetic agitating method according to claim 1, wherein the thrust force generated in the slab drawing direction is 2500 to 11,000 $N/m^3$.

7. An electromagnetic agitating method according to claim 1, wherein the thrust force generated in the slab drawing direction is 4500 to 9000 $N/m^3$.

8. An electromagnetic agitating method according to claim 1, wherein the thrust force generated in the slab drawing direction is 5500 to 8000 $N/m^3$.

* * * * *